US006800822B2

(12) United States Patent
Hamada et al.

(10) Patent No.: US 6,800,822 B2
(45) Date of Patent: Oct. 5, 2004

(54) CIRCUIT BREAKER

(75) Inventors: Yoshinobu Hamada, Saitama (JP); Tatsunori Takahashi, Tokyo (JP); Koji Asakawa, Saitama (JP); Katsunori Kuboyama, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/440,109

(22) Filed: May 19, 2003

(65) Prior Publication Data

US 2003/0217912 A1 Nov. 27, 2003

(30) Foreign Application Priority Data

May 27, 2002 (JP) ..... 2002-152666

(51) Int. Cl.[7] ..... H01H 9/00
(52) U.S. Cl. ..... 200/318.1; 200/308
(58) Field of Search ..... 200/17 R, 308, 200/323, 318–318.2, 520–522, 564, 572, 324, 327–331, 43.13

(56) References Cited

U.S. PATENT DOCUMENTS 5,459,446 A * 10/1995 Vidal et al. ..... 200/314
5,477,016 A * 12/1995 Baginski et al. ..... 200/43.11
5,808,252 A * 9/1998 Makuc et al. ..... 200/50.01
6,066,821 A * 5/2000 Wehrli et al. ..... 200/552
6,225,883 B1 * 5/2001 Wellner et al. ..... 200/400

FOREIGN PATENT DOCUMENTS

JP 5-12977 1/1993

* cited by examiner

*Primary Examiner*—Lincoln Donovan
*Assistant Examiner*—M. Fishman
(74) *Attorney, Agent, or Firm*—Manabu Kanesaka

(57) ABSTRACT

A circuit breaker for opening and closing a main-circuit includes main-circuit contacts; an opening-and-closing mechanism having a switching lever for opening and closing the main-circuit contacts, a main spring for urging the switching lever, and a toggle-link mechanism attached to the switching lever; and an operational handle. The operational handle includes a locker handle rotatably supported on a handle pin and connected to the toggle link of the switching mechanism, and a pushbutton linked to the handle. When the pushbutton is pushed, the handle portion rotates to allow the switching lever to close the main-circuit contacts.

9 Claims, 7 Drawing Sheets

Fig. 1(a)
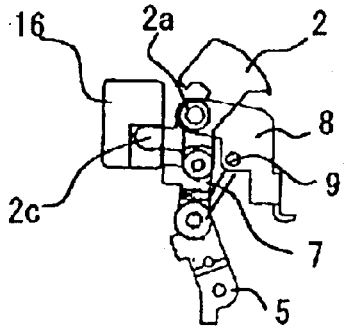
Fig. 1(b)
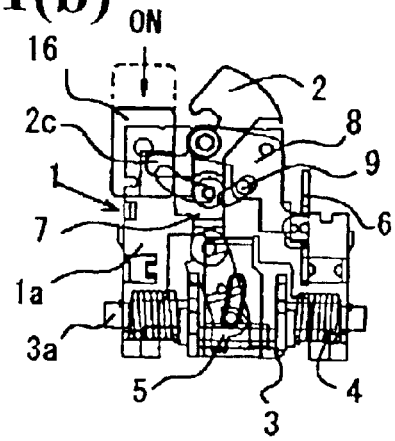
Fig. 1(c)
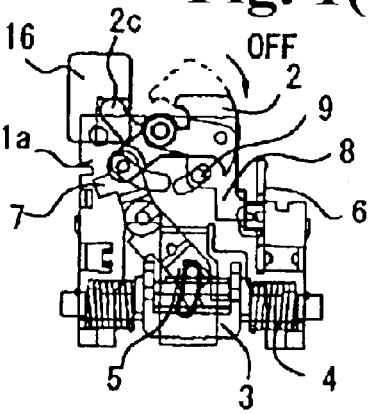
Fig. 2(a)
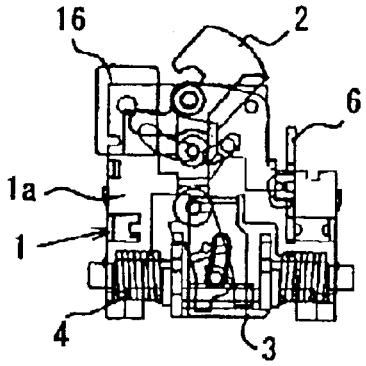
Fig. 2(b)
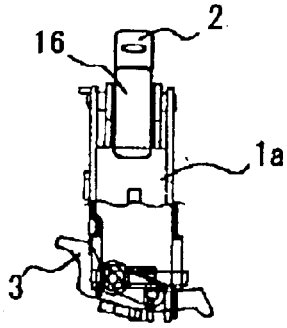
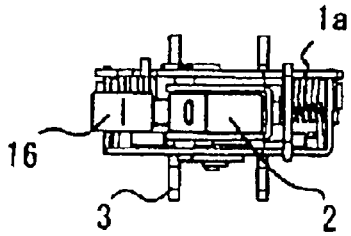
Fig. 2(c)

Fig. 3(a)
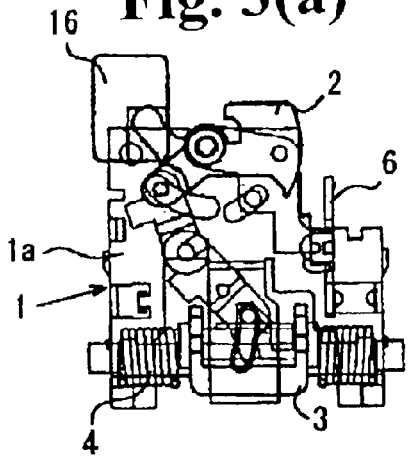
Fig. 3(b)
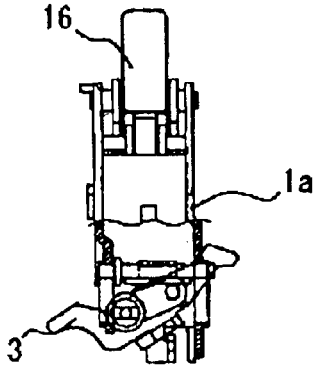
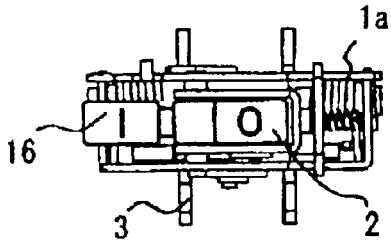
Fig. 3(c)
Fig. 4(a)
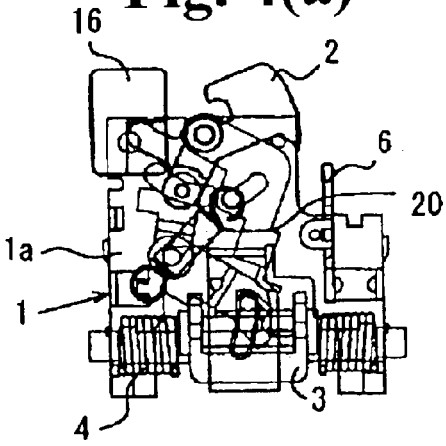
Fig. 4(b)
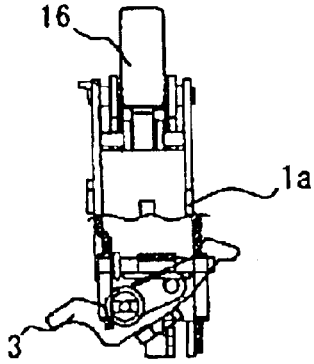
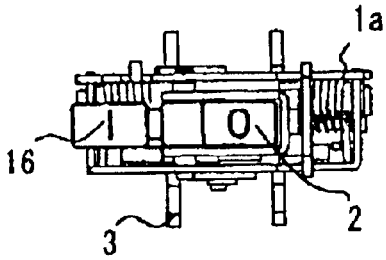
Fig. 4(c)

Fig. 5(a)
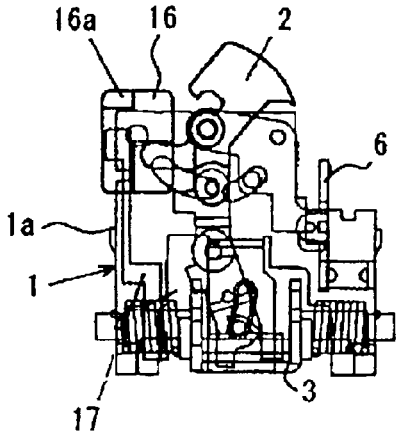
Fig. 5(b)
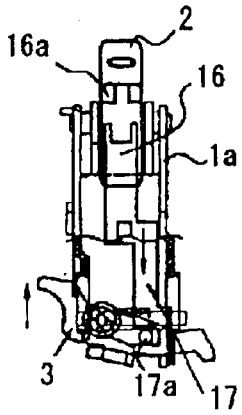
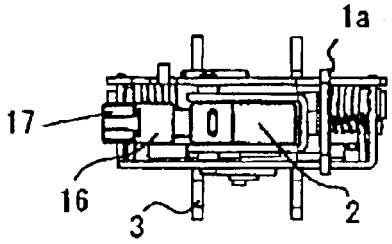
Fig. 5(c)
Fig. 6(a)
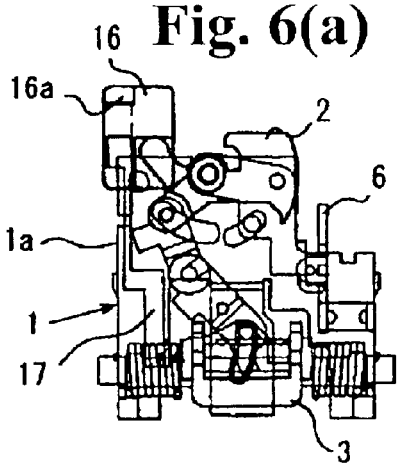
Fig. 6(b)
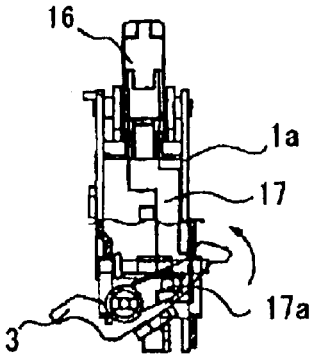
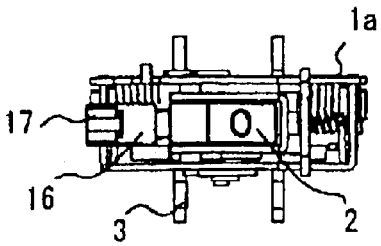
Fig. 6(c)

Fig. 7(a)
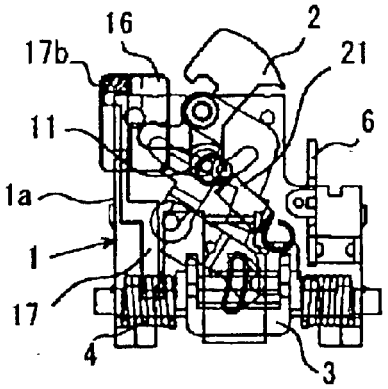
Fig. 7(b)
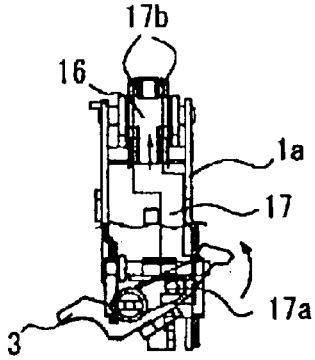
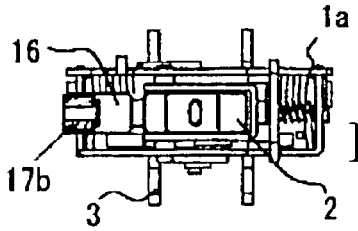
Fig. 7(c)
Fig. 8(a)
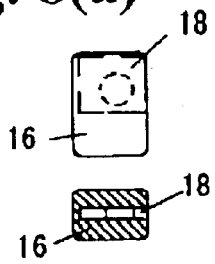
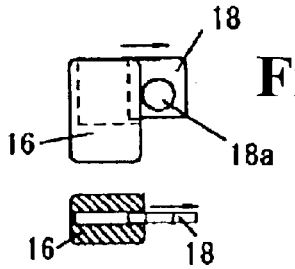
Fig. 8(b)
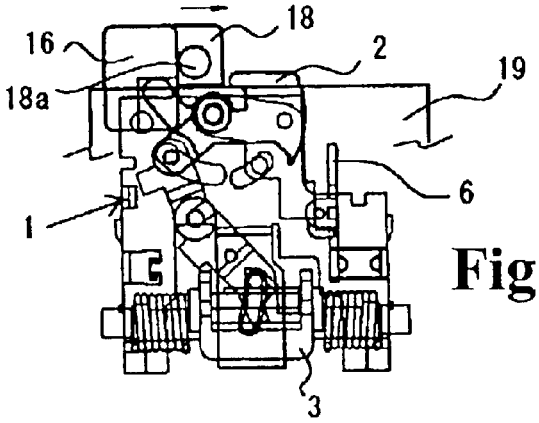
Fig. 8(c)

CIRCUIT BREAKER

BACKGROUND OF THE INVENTION AND RELATED ART STATEMENT

The present invention relates to a circuit breaker for a power supply circuit of an electric motor, and, in particular, to an opening-and-closing operation handle-mechanism for the circuit breaker.

Japanese Patent Publication (Tokkai) No. 2001-23499 has disclosed a configuration of an opening-and-closing mechanism for a circuit breaker. With reference to FIGS. 9 and 10, a structure and operation of the opening-and-closing mechanism will be explained.

As shown in FIGS. 9 and 10, reference numeral 1 denotes an opening-and-closing mechanism, and reference numeral 2 denotes a locker handle installed at a top of an assembly frame of the opening-and-closing mechanism for an opening-and-closing operation. Reference numeral 3 denotes an opening-and-closing lever for turning on and driving the main-circuit contacts (not shown) to an open position, and reference numeral 4 denotes a main spring (torsion coil spring) provided around a support shaft 3*a* of the opening-and-closing lever 3 to urge the main-circuit contacts in an opening direction. Reference numeral 5 denotes a transmission plate having a lower end linked to the opening-and-closing lever 3, and reference numeral 6 denotes a latch receiver for responding to an output from an over-current tripping device (not shown).

The locker handle 2 is linked to the transmission plate 5 and the latch receiver 6 via a toggle-link mechanism comprising a combination of a toggle link 7, a latch 8, and a U-shaped pin 9. The toggle-link mechanism and the locker handle as a whole constitute a four-node link. Reference numeral 10 denotes an alarm output plate, and reference numeral 10*a* denotes a spring extending between the alarm output plate 10 and a pin of the toggle-link mechanism.

The locker handle 2 is also known as a see-saw-type handle. A handle knob (molded resin) having an M-shape is rotatably supported on the assembly frame 1*a* of the opening-and-closing mechanism 1 at the middle thereof via a handle pin 2*a* (support shaft). A handle link projecting downward and having a rotational center shifted from the pin 2 is connected to an upper end of the toggle link 7 through a pin 11. A lock hole 2*b* is formed in the handle knob of the locker handle 2 so that a padlock (not shown) can be inserted into the lock hole 2*b* to lock the handle at the OFF position.

Further, one end of the latch 8 is pivotally supported on the pin 2*a* and the tip pawl is engaged the latch receiver 6. Furthermore, the U-shaped pin 9 has one end coupled to a central portion of the latch 8 and the other end connecting the lower end of the toggle link 7 to the upper end of the transmission plate 5.

An operation of the opening-and-closing mechanism will be described with reference to FIGS. 11(*a*)–11(*c*). FIGS. 11(*a*)–11(*c*) show an ON operation of the opening-and-closing mechanism during, an OFF operation thereof, and a trip operation thereof, respectively. The opening-and-closing lever 3 provided in the opening-and-closing mechanism 2 is linked to the main-circuit contacts of the circuit breaker as shown in FIG. 12(*a*). In FIG. 12(*a*), reference numerals 12, 13, and 14 denote a fixed contactor, a movable contactor (bridging contactor), and a contact-pressure spring for the movable contactor, respectively.

Reference numeral 15 denotes a driving block coupled to the movable contactor 13 so as to face the opening-and-closing lever 3. When a rotational operation force F is exerted on the locker handle 2 in the direction indicated by the arrow in FIG. 12(*b*), the main-circuit contacts are closed or opened via the opening-and-closing lever 3 of the opening-and-closing mechanism 1.

When the locker handle 2 is rotated counterclockwise to perform the ON operation as shown in FIG. 11(*a*) via the toggle link 7, the transmission plate 5 pushes down a rear end of the opening-and-closing lever 3. Thus, a tip of the opening-and-closing lever 3 retreats upward while accumulating an urging force of the main spring 4. In response to this, the movable contactor 13 (see FIG. 12(*a*)) contacts the fixed contactor 12 under pressure from the spring force of the contact-pressure spring 14. The main-circuit contacts are thus closed.

In this state, when the locker handle 2 is rotated clockwise to perform the OFF operation as shown in FIG. 11(*b*), the transmission plate 5 releases the opening-and-closing lever 3. The spring force accumulated by the main spring 4 is thus released. Therefore, the opening-and-closing lever 3 pushes down the block 15, as shown in FIG. 12(*a*), to open and separate the movable contactor 13 from the fixed contactor 12.

When an over-current flows through the main circuit of the circuit breaker to actuate a tripping device (not shown), the latch receiver 6 is tilted to release the latch 8 as shown in FIG. 11(*c*). The latch 8 rotates clockwise to tilt the transmission plate 5 via the U-shaped pin 9 in order to unbind the opening-and-closing lever 3. As a result, the opening-and-closing lever 3 is rotated under the spring force of the main spring 4 to push down the block as shown in FIG. 12(*a*). The movable contactor 13 is thus opened and separated from the fixed contactor 12. In this case, as the latch 8 is released, the locker handle 2 is stopped by the spring force of a trip spring 10*a* (see FIG. 9) at a trip display position of halfway between an ON position and OFF position, and the locker handle 2 extends in a horizontal direction.

The locker handle 2 can be switched with one finger. However, the circuit breaker provided with the locker handle has the following problems.

When the circuit breaker is turned on, the rotating operation force is exerted on the knob of the locker handle 2 as shown in FIG. 12(*b*) to rotate the locker handle 2 around the handle pin 2*a* from the OFF position (solid line) to the ON position (hidden line). The main-circuit contacts are thus closed. A characteristic line F in FIG. 13 represents a handle load during this turn-on operation. In this case, the handle load is substantially constant at a value F1 between the OFF position and a point A at which the movable contactor 13 abuts against the fixed contactor 12. Once the movable contactor 13 reaches the point A from the open position, the spring force of the contact-pressure spring 14, which urges the opening-and-closing lever 3 to push up, is applied to the fixed contactor 12. As a result, the handle load increases from F1 to F2 in a stepwise manner. Beyond the point A, the handle load decreases toward the ON position.

When an operator rotates the locker handle 2 with an operation force corresponding to the handle load F1 for turning on the circuit breaker, there is a sudden increase in the handle load at the point A. It is necessary for the operator to increase the operation force in order to rotate the handle further to the ON position. Accordingly, after the point A, the handle is slowly operated to shift the main-circuit contacts to the closed position.

When the circuit breaker is turned on to activate the motor, a starting current six times larger than the rated current flows. Therefore, when the circuit breaker is turned on slowly, it is possible that an arc is generated between the fixed and movable contacts, thereby damaging or wearing the contacts, or melting the contacts to stick with each other.

For this reason, when the circuit board is turned on, it is important to move the handle from the OFF position to the ON position quickly so as to shift the main-circuit contacts from the open position to the closed position without stopping. However, with the conventional locker handle, when the ON operation is started, the handle can move without a large operation force. When the main-circuit contacts contact with each other at the point A, the handle load suddenly increases. Accordingly, it is difficult to move the handle from the OFF position to the ON position in a single smooth movement without reducing the operation speed.

Further, the conventional locker involves other problems. The knob of the locker handle 2 has an M-shape so that an operation surface exhibits different angles at the ON position and the. OFF position, as shown in the FIGS. 11(*a*)–11(*c*). Therefore, it may be difficult to identify a display mark on the operation surface that indicates the operation state of the breaker, depending on a direction from which the mark is viewed.

Also, the conventional locker handle 2 has the lock hole 2*b* (see FIG. 10) formed in the handle knob. A padlock passes through the lock hole 2*b* to lock the handle at the OFF position, i.e. the circuit breaker is in the open state, to prevent accidental electric shock during the maintenance inspection of an electric switchboard provided with the circuit breaker or the like. In a case that the main-circuit contacts are melted and stuck with each other, the opening-and-closing lever 3 of the opening-and-closing mechanism stops at a position between the open and closed positions. In this state, the lock hole 2*b* in the locker handle 2 is exposed from the breaker case. Consequently, a maintenance engineer may mistakenly confirm that the circuit breaker can be locked (the main-circuit contacts are turned off).

The present invention is provided in view of the above problems, and an object of the present invention is to provide a circuit breaker with a handle mechanism for providing an improved operation of the handle when the circuit breaker is turned on. With the circuit breaker of the present invention, it is also possible to securely display and identify an operation state of the circuit breaker and a trip operation, and to securely lock the handle with a padlock.

Further objects and advantages of the invention will be apparent from the following description of the invention.

SUMMARY OF THE INVENTION

To accomplish the objects, the present invention provides a circuit breaker that opens or closes main-circuit contacts via an opening-and-closing mechanism when a handle is operated. The opening-and-closing mechanism includes an opening-and-closing lever urged by a main spring and a toggle-link mechanism that links the opening-and-closing lever to the operation handle. When the handle is operated to turn on, the main-circuit contacts are closed while the main spring accumulates spring force. When the handle is operated to turn off or a trip operation is performed, the main-circuit contacts are opened by releasing the spring force accumulated in the main spring.

In the invention, the operation handle of the circuit breaker includes a rotating locker handle supported on a handle pin and connected to a toggle link of the opening-and-closing mechanism, and a turn-on pushbutton linked to the locker handle. When the circuit breaker is turned on, the pushbutton is pushed to rotate the locker handle to the ON position so that the main-circuit contacts are closed. As a specific linkage structure, the locker handle is provided with an interlocking arm projecting toward the pushbutton, and a tip of the interlocking arm is fitted into a concavity formed in the pushbutton to link the locker handle to the pushbutton.

With the configuration in which the rotating locker handle provided with the push-in type turn-on pushbutton, when the pushbutton in the protruding OFF position is pushed in to turn on the circuit breaker, the interlinking arm of the locker handle fitted into the concavity in the pushbutton is pushed down. As a result, the locker handle rotates around the pin from the OFF position to the ON position. The main-circuit contacts are thus closed via the opening-and-closing mechanism.

To push the pushbutton from the OFF position to the ON position, it is required to operate with a force greater than that for manually rotating the locker handle to the ON position. Further, the operation force is greater than the handle load, which increases when the main-circuit contact contacts the fixed contactor during the turn-on operation of the circuit breaker. Accordingly, when the turn-on pushbutton is pushed with such operation force, the locker handle smoothly switches to the ON position in a single movement without slowing down in the middle of the switching operation when the locker handle passes the contacting point of the main-circuit contacts. Therefore, it is possible to obtain a quick and stable turn-on operation.

As previously described, the locker handle and the pushbutton are linked together by fitting the linking arm of the locker handle into the concavity in the pushbutton. Thus, it is possible to adjust an operational characteristic of the handle by varying a contact angle between the linking arm of the locker handle and the pushbutton.

According to the present invention, it is possible to combine the following functional parts with the operation handle having the pushbutton.

The opening-and-closing mechanism may be provided with a trip spring for holding the locker handle and the pushbutton at a trip display position halfway between the ON position and the OFF position during the trip operation. As a result, it is possible to identify the trip operation through a position of the handle.

In addition to the trip spring described above, the opening-and-closing mechanism may be provided with a trip display bar having one end connected to the opening-and-closing lever and extending to a position of the pushbutton of the operation handle. Upon the trip operation, a tip of the trip display bar projects to a position flush with a top surface of the pushbutton for display.

Further, the pushbutton may be provided with a lock plate that can be pulled out from a storage position onto a case only when the main-circuit contacts are open in the OFF position. Consequently, when the opening-and-closing lever of the opening-and-closing mechanism is stopped at a position between the ON and OFF positions due to, for example, melted main-circuit contacts, it is not possible to pull out the lock plate, thereby preventing the handle from being locked inadvertently.

BRIEF DESCRIPTION OF THE DRAWINGS

FIGS. 1(*a*)–1(*c*) are views showing an operation handle according to the present invention, wherein FIG. 1(*a*) is a view showing a linkage structure between a locker handle and a pushbutton, and FIGS. 1(*b*) and 1(*c*) are views illustrating an ON operation and an OFF operation, respectively;

FIGS. 2(*a*)–2(*c*) are views showing an ON operation of an opening-and-closing mechanism having the operation handle in FIGS. 1(*a*)–1(*c*), wherein FIG. 2(*a*) is a side view thereof, FIG. 2(*b*) is an end view thereof, and FIG. 2(*c*) is a plan view thereof;

FIGS. 3(*a*)–3(*c*) are views showing an OFF operation of the opening-and-closing mechanism having the operation handle in FIGS. 1(*a*)–1(*c*), wherein FIG. 3(*a*) is a side view thereof, FIG. 3(*b*) is an end view thereof, and FIG. 3(*c*) is a plan view thereof;

FIGS. 4(*a*)–4(*c*) are views showing a trip operation of the opening-and-closing mechanism having the operation handle in FIGS. 1(*a*)–1(*c*), wherein FIG. 4(*a*) is a side view thereof, FIG. 4(*b*) is an end view thereof, and FIG. 4(*c*) is a plan view thereof;

FIGS. 5(*a*)–5(*c*) are views showing an ON operation of an opening-and-closing mechanism having a trip display bar according to the present invention, wherein FIG. 5(*a*) is a side view thereof, FIG. 5(*b*) is an end view thereof, and FIG. 5(*c*) is a plan view thereof;

FIGS. 6(*a*)–6(*c*) are views showing an OFF operation of the opening-and-closing mechanism in FIGS. 5(*a*)–5(*c*), wherein FIG. 5(*a*) is a side view thereof, FIG. 5(*b*) is an end view thereof, and FIG. 5(*c*) is a plan view thereof;

FIGS. 7(*a*)–7(*c*) are views showing a trip operation of the opening-and-closing mechanism in FIGS. 5(*a*)–5(*c*), wherein FIG. 7(*a*) is a side view thereof, FIG. 7(*b*) is an end view thereof, and FIG. 7(*c*) is a plan view thereof;

FIGS. 8(*a*)–8(*c*) are views showing a structure of a pushbutton with a lock plate and a lock operation according to the present invention, wherein FIGS. 8(*a*) and 8(*b*) are a side view and a sectional view of the pushbutton showing a state that a lock plate is stored and a state that the lock plate is pulled out, respectively, and FIG. 8(*c*) is a view showing the lock operation of a handle in a circuit breaker;

DETAILED DESCRIPTION OF PREFERRED EMBODIMENTS

Figure 9:
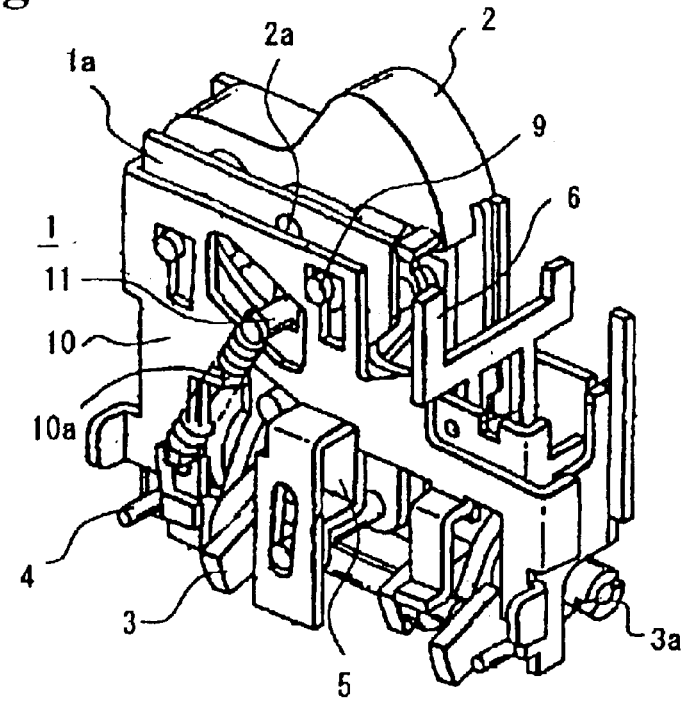
Fig. 9 Prior Art
FIG. 9 is a perspective view of a conventional opening-and-closing mechanism having a locker handle.
Figure 10:
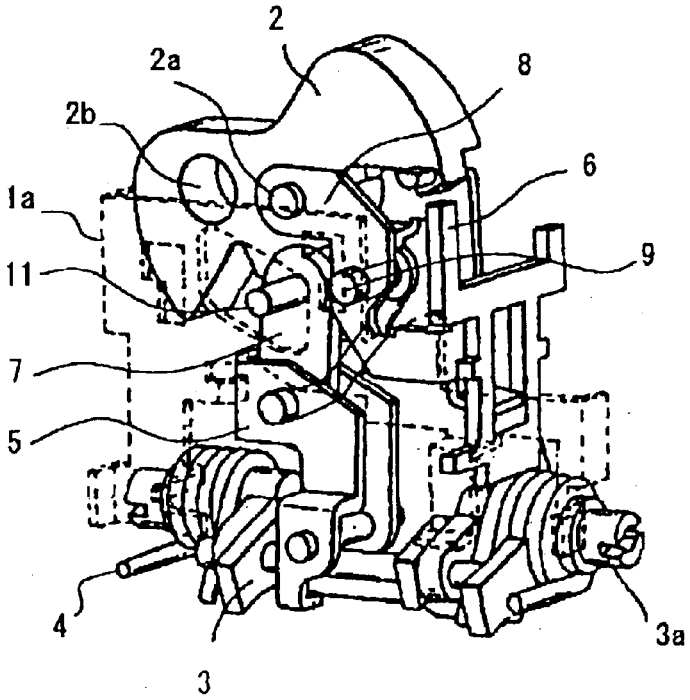
Fig. 10 Prior Art
FIG. 10 is a view showing an interior of the opening-and-closing mechanism in FIG. 9.
Figure 11A:
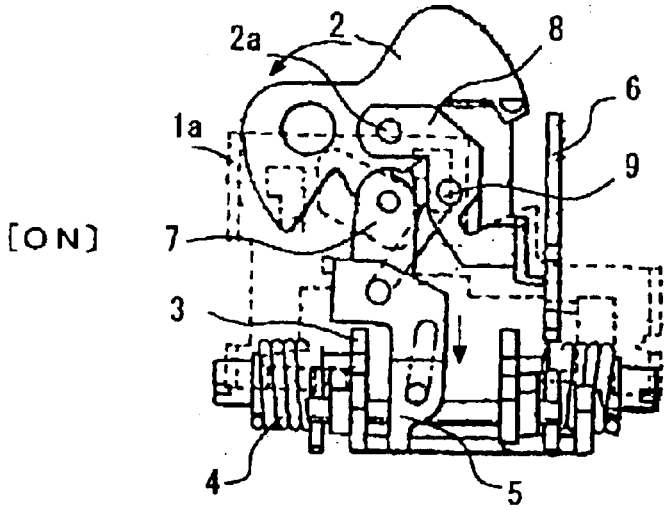
Fig. 11(a) Prior Art
FIGS. 11(*a*)–11(*c*) are views showing an operation of the opening-and-closing mechanism in FIG. 10, wherein FIG. 11(*a*) is a view showing an ON operation, FIG. 11(*b*) is a view showing an OFF operation, and FIG. 11(*c*) is view showing a trip operation.
Figure 11B:
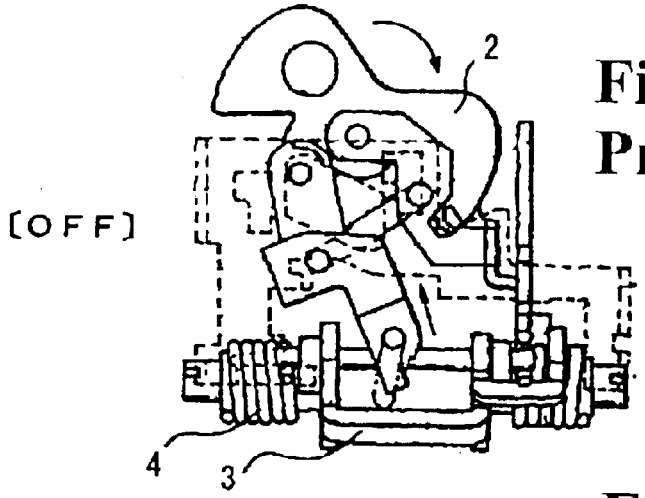
Fig. 11(b) Prior Art
Figure 11C:
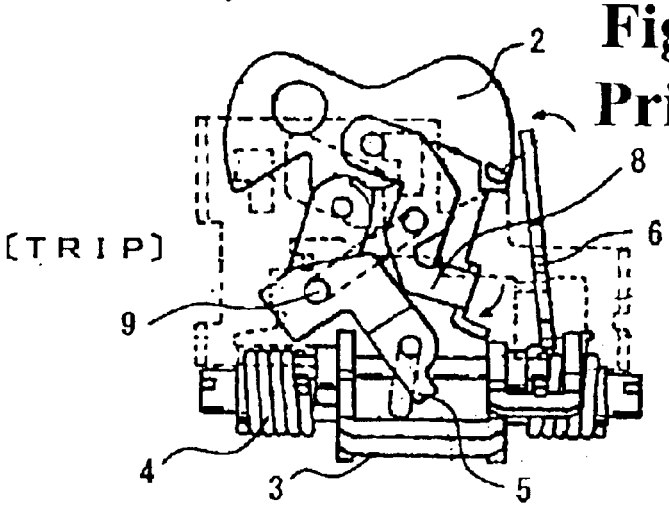
Fig. 11(c) Prior Art
Figure 12A:
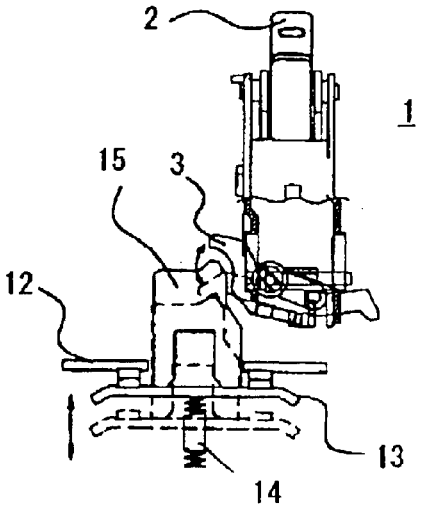
Fig. 12(a) Prior Art
FIGS. 12(*a*) and 12(*b*) are views showing a structure of a linkage and an operation of the handle shown in FIG. 9, wherein FIG. 12(*a*) is a view showing the structure of the linkage between the opening-and-closing mechanism and main-circuit contacts, and FIG. 12(*b*) is a view showing an ON-OFF operation of a locker handle.
Figure 12B:
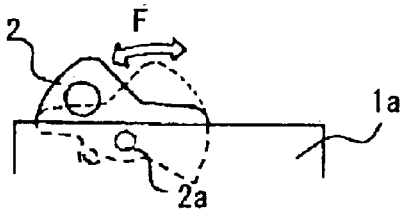
Fig. 12(b) Prior Art

Hereunder, embodiments of the present invention will be described with reference to the accompanying drawings. In the embodiments, components corresponding to those in FIGS. 9 to 12(*a*) and 12(*b*) are denoted by the same reference numerals, and their detailed descriptions are omitted.

FIGS. 1(*a*)–1(*c*) are views showing a structure of an operation handle and an operation of the handle at ON and OFF positions. In this embodiment, the operation handle is composed of a rotating locker handle 2 and a pushbutton 16 linked to the locker handle 2 via an interlocking arm 2*c*. A knob of the locker handle 2 lacks a left half thereof as opposed to a conventional locker handle shown in FIG. 10, and instead is provided with an interlocking arm 2*c* extending leftward toward the pushbutton 16.

As in the conventional locker handle, the locker handle is supported on a handle pin 2*a*, and a link portion projecting downward and having a rotational center shifted from the pin 2*a* is connected to an upper end of a toggle link 7. The pushbutton 16 is formed in a rectangular prism shape (molded resin) having a top surface as an operation surface, and is guided to be movable in the vertical direction. The pushbutton 16 has a concavity formed at a lower portion thereof. A tip of the interlocking arm 2*c* of the locker handle 2 is fitted into the concavity of the pushbutton 16 to link the locker handle 2 to the pushbutton 16. It is preferable to mark the operation surfaces of the locker handle 2 and the pushbutton 16 in different colors for visual identification.

With the above configuration, when the circuit breaker is turned on, the pushbutton 16 is pushed with a finger as shown in FIG. 1(*b*). When the circuit breaker is opened or turned off, the locker handle 2 is rotated clockwise with a finger as shown in FIG. 1(*c*). In the OFF state, the pushbutton 16 is pushed upward via the interlocking arm 2*c* of the locker handle 2 to project up to a height corresponding to an OFF position. In the ON state, the pushbutton 16 pushes the interlocking arm 2*c* of the locker handle 2 down. The locker handle 2 thus rotates counterclockwise to project the knob upward. When the locker handle 2 is rotated to the ON or OFF position, the opening-and-closing lever 3 of the opening-and-closing mechanism 1 opens or closes the main-circuit contacts (not shown) of the circuit breaker.

FIGS. 2(*a*)–2(*c*) are views showing a state where the locker handle is operated in the ON operation. FIGS. 3(*a*)–3(*c*) are views showing a state where the locker handle is operated in the OFF operation. FIGS. 4(*a*)–4(*c*) are views showing a state where the circuit breaker is in the trip state. As shown in FIGS. 4(*a*)–4(*c*), a display spring 20 is extended diagonally between a U-shaped pin 9 coupled to a latch 6 (see FIGS. 1(*a*)–1(*c*)) of the opening-and-closing mechanism 1 and a frame 1*a*. The display spring urges the locker handle 2 and the pushbutton 16 to stop at substantially the same height between the ON and OFF positions during a trip operation of the circuit breaker, as shown in FIGS. 4(*a*)–4(*c*).

Figure 13:
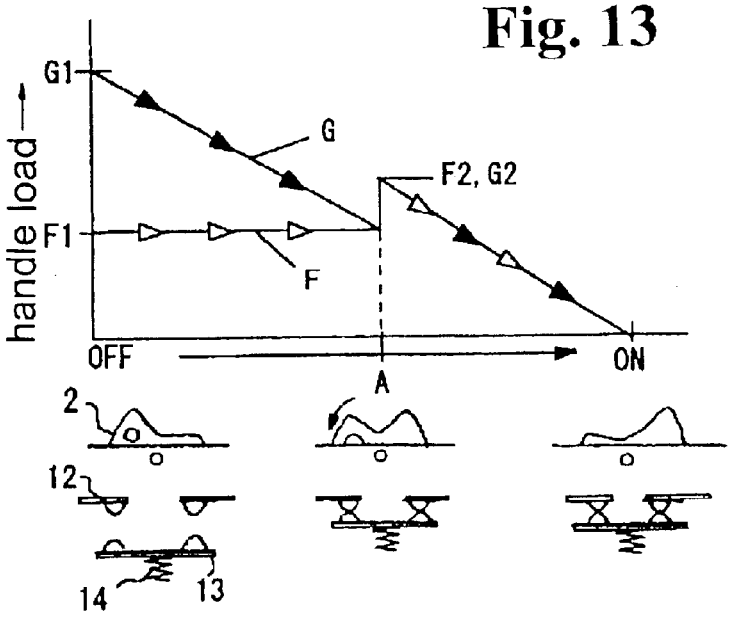
FIG. 13 is a diagram showing an operational characteristic of a handle when the main-circuit contacts are turned on corresponding to FIGS. 12(*a*) and 12(*b*).

In the configuration in which the pushbutton 16 is combined with the rotating locker handle 2 as described above, the handle has an operation characteristic indicated by line G in FIG. 13 during the turn-on operation. As shown in FIG. 1(*b*), the pushbutton 16 is pushed in from the OFF position indicated by a hidden line to the ON position to turn on the circuit breaker via the locker handle 2. At a start of the operation, a handle load G1 imposed on the pushbutton 16 is greater than a handle load F1 for rotating the locker handle 2 from the OFF position to the ON position. That is, in the vertical force exerted on the pushbutton 16, vector component in a rotational direction is applied on the locker handle 2 for rotating the same. The handle load G1 is also greater than a handle load G2, which increases at a point A where the main-circuit contacts are contacted during the ON operation.

Accordingly, when the pushbutton 16 is pushed in to turn on the circuit breaker with the operation force corresponding to the handle load G1, the locker handle 2 is switched to the ON position in a single movement without slowing at the point A of the main-circuit contacts. Therefore, it is possible to obtain a quick and stable turn-on operation, and to prevent an arc at the main-circuit contacts caused by the starting current of a motor. The arc has been a problem with the conventional locker handle. It is also possible to avoid damaging or wearing of the contacts, or melting and adhering due to the arc.

The handle operation characteristic (the characteristic line G) is a function of a contact angle between the interlocking arm 2*c* of the locker handle 2 and the concavity formed in the pushbutton 16 against which the interlocking arm 2*c* abuts. Thus, it is possible to adjust the contact angle between the pushbutton 16 and the interlocking arm 2*c* of the locker handle 2 (specifically, the angle between the tip of the interlocking arm 2*c* and the wall surface of the concavity formed in the pushbutton 16 against which the tip of the interlocking arm 2*c* abuts) to obtain the quick turn-on operation. As a result, the handle load G1 shown in FIG. 13 can be set at an optimal value for a smooth operation of the handle.

FIGS. 5(*a*)–5(*c*) to 7(*a*)–7(*c*) show another embodiment of the present invention. In addition to the configuration in the embodiment described above, according to this embodiment, the opening-and-closing mechanism 1 is provided with a trip display bar 17 having one end connected to the opening-and-closing lever 3 and the other end extending upward up to a position of the pushbutton 16. When the circuit breaker performs the trip operation, a display portion at an end of the trip display bar 17 projects to a position flush with a top surface of the pushbutton 16 to display the trip operation.

As shown in FIG. 5(*b*), the trip display bar 17 has a lower end connected to a rear end of the opening-and-closing lever 3 via a connecting pin 17*a*. The display portion having a branched projection is formed at the upper end of the trip display bar 17. The display portion is inserted into through-holes 16*a* formed in the right and left sides of the pushbutton 16. The display portion at the upper end of the trip display bar 17 is marked in red for easy determination of the trip state. Further, a display spring 21 is extended between the frame 1*a* and the pin 11 connecting the locker handle 2 to the toggle link.

With this configuration, in the ON state shown in FIGS. 5(*a*)–5(*c*), the trip display bar 17 retreats to a lower position along with the opening-and-closing lever 3. Accordingly, the display portion at the upper end is behind the pushbutton 16. In the OFF state shown in FIGS. 6(*a*)–6(*c*), the opening-and-closing lever 3 rotates counterclockwise, and the trip display bar 17 elevates. In this state, the pushbutton 16 is pushed up to the OFF position, so that the display portion of the trip display bar 17 is not exposed above the top surface of the pushbutton.

When the circuit breaker performs the trip operation, the trip display bar 17 is pushed up along with the rotation of the opening-and-closing lever 3, while the pushbutton 16 stays at substantially the same position as the ON position by the urging force of the display spring 21. As a result, as shown in FIGS. 7(*a*)–7(*c*), the leading display portion 17*b* of the trip display bar 17 projects from the top surface of the pushbutton 16. An operator can therefore visually determine that the circuit breaker has performed the trip operation.

FIGS. 8(*a*)–8(*c*) are views showing another embodiment of the present invention. In this embodiment, a slit space is formed at an upper half center of the pushbutton 16 having an prism shape. The slit space has one end opened at the right side of the pushbutton 16. A lock plate 18 having a lock hole 18*a* for inserting a padlock is stored in the slit space.

In this configuration, the lock plate 18 is normally stored in the space in the pushbutton 16, as shown in FIG. 8(*a*). When the operation handle is moved to the OFF position to open the main-circuit contacts of the circuit breaker as shown in FIG. 8(*c*), the pushbutton 16 projects upward from the breaker case 19 (FIG. 8(*b*)). Incidentally, a side and a section of the lock plate 18 and the pushbutton 16 are respectively shown in FIGS. 8(*a*) and 8(*b*). In this state, the lock plate 18 is pulled out from the pushbutton 16 onto the case 19, and the pushbutton is locked at this position. Then, a padlock is inserted into the lock hole 18*a* to lock the operation handle at the OFF position. In contrast, when the handle is moved to the ON position, in which the main-circuit contacts are closed, the pushbutton 16 is pushed into the case 19, so that the lock plate 18 can not be pulled out.

In a case that the operation handle is moved to the OFF position during electric conduction without knowing that the main-circuit contacts are melted and adhered to each other, the pushbutton 16 is stopped at a position between the ON and OFF positions rather than returning to the OFF position. Consequently, in this state, it is not possible to pull out the lock plate 18 to lock the handle at the OFF position, as the lock plate 18 is stored in the pushbutton. As a result, the operator can determine that an accident has occurred in the circuit breaker (the contacts are melted and adhered to each other), thereby preventing an accidental operation using the locker handle. In the prior art, even when the contacts are melted and adhered to each other, the handle can be moved to the OFF position to expose a part of the handle lock hole from the case. Consequently, the operator mistakenly concludes that the circuit breaker can be locked, and then passes a pin or the like through the lock hole for locking. The present invention can prevent such an erroneous operation and is thus more reliable.

As described above, according to the present invention, the operation handle of the circuit breaker comprises a combination of the rotating locker handle supported on the handle pin and connected to the toggle link of the opening-and-closing mechanism, and the turn-on pushbutton linked to the locker handle. When the circuit breaker is turned on, the pushbutton is pushed to rotate the locker handle to the ON position to close the main-circuit contacts.

Thus, when the circuit breaker is turned on, the handle can be switched to the ON position without stopping or slowing, thereby obtaining a quick and stable turn-on operation.

Further, with the configurations described above, the operational state of the circuit breaker, including the trip operation, can be determined by visually checking the handle. Furthermore, it is possible to prevent an erroneous operation when the operation handle is locked at the OFF position.

While the invention has been explained with reference to the specific embodiments of the invention, the explanation is illustrative and the invention is limited only by the appended claims.

What is claimed is:

1. A circuit breaker, comprising:

main-circuit contacts, an opening-and-closing mechanism having a frame with a handle pin, a switching lever for opening and closing the main-circuit contacts, a main spring for urging the switching lever, and a toggle-link mechanism attached to the switching lever, and an operational handle including a locker handle rotatably supported on the handle pin to swing relative to the frame and connected to the toggle-link mechanism, and a pushbutton situated adjacent to the locker handle and vertically slidably attached to the frame, said pushbutton being linked to one side of the locker handle so that when the pushbutton is pushed, the locker handle rotates around the handle pin to an ON position and the main-circuit contacts are closed through the switching lever.

2. A circuit breaker according to claim 1, wherein said locker handle is provided with an interlocking arm projecting toward the pushbutton, and said pushbutton is provided with a concavity for receiving a tip of the interlocking arm to link the locker handle to the pushbutton.

3. A circuit breaker according to claim 1, wherein said opening-and-closing mechanism further includes a trip spring for holding the locker handle and the pushbutton at a trip position upon a trip operation in which the main spring snaps back to open the main-circuit contacts.

4. A circuit breaker according to claim 3, wherein said trip position is located between the ON position in which the pushbutton is pushed to close the main-circuit contacts and an OFF position in which the locker handle is operated to open the main-circuit contacts.

5. A circuit breaker according to claim 3, wherein said opening-and-closing mechanism further includes a trip display bar having one end connected to the switching lever and extending to the pushbutton of the operation handle so that a tip of the trip display bar projects to a position flush with a top surface of the pushbutton upon the trip operation.

6. A circuit breaker according to claim 1, wherein said pushbutton further includes a lock plate stored therein so that the lock plate can be pulled out from the pushbutton only when the pushbutton is at an OFF position in which the main-circuit contacts are open.

7. A circuit breaker according to claim 1, wherein said main spring is connected to the switching lever such that upon an ON operation of the operation handle, the main-circuit contacts are closed while the main spring is compressed, and upon an OFF operation and a trip operation, the main-circuit contacts are opened by a compression force of the main spring.

8. A circuit breaker according to claim 2, wherein the tip of the interlocking arm is inclined relative to a wall surface of the concavity to provide quick turn-on operation.

9. A circuit breaker, comprising:

main-circuit contacts, an opening-and-closing mechanism having a switching lever for opening and closing the main-circuit contacts, a main spring for urging the switching lever, a toggle-link mechanism attached to the switching lever, a trip spring, and a trip display bar having one end connected to the switching lever, and an operational handle including a locker handle rotatably supported on a handle pin and connected to the toggle-link mechanism, and a pushbutton linked to the locker handle so that when the pushbutton is pushed, the locker handle rotates to an ON position and the main-circuit contacts are closed through the switching lever, said locker handle and the pushbutton being held by the trip spring at a trip position upon a trip operation in which the main spring snaps back to open the main-circuit contacts, said trip display bar extending to the pushbutton so that a tip of the trip display bar projects to a position flush with a top surface of the pushbutton upon the trip operation.

* * * * *